US010126669B2

(12) United States Patent
Ojima

(10) Patent No.: US 10,126,669 B2
(45) Date of Patent: Nov. 13, 2018

(54) ELECTROSTATIC LATENT IMAGE DEVELOPING TONER

(71) Applicant: KYOCERA Document Solutions Inc., Osaka (JP)

(72) Inventor: Seishi Ojima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/646,573

(22) Filed: Jul. 11, 2017

(65) Prior Publication Data

US 2018/0024454 A1 Jan. 25, 2018

(30) Foreign Application Priority Data

Jul. 25, 2016 (JP) ..... 2016-145409

(51) Int. Cl.
*G03G 9/093* (2006.01)
*G03G 9/08* (2006.01)

(52) U.S. Cl.
CPC ..... *G03G 9/09321* (2013.01); *G03G 9/0819* (2013.01); *G03G 9/0825* (2013.01); *G03G 9/09314* (2013.01); *G03G 9/09342* (2013.01); *G03G 9/09371* (2013.01); *G03G 9/09392* (2013.01)

(58) Field of Classification Search
CPC ..... G03G 9/09321; G03G 9/09371; G03G 9/09314
See application file for complete search history.

(56) References Cited

U.S. PATENT DOCUMENTS 7,514,194 B2 * 4/2009 Iijima ..... G03G 9/0804 430/108.1
7,881,648 B2 * 2/2011 Yoshida ..... G03G 9/08722 399/286
8,703,374 B2 * 4/2014 Sweeney ..... G03G 9/0819 430/108.11
2009/0246681 A1 * 10/2009 Kawamura ..... G03G 9/0804 430/137.14
2009/0297225 A1 * 12/2009 Yamada ..... G03G 9/0819 399/252
2012/0082929 A1 * 4/2012 Ikami ..... G03G 9/0804 430/111.4
2012/0189953 A1 * 7/2012 Tujihiro ..... G03G 9/081 430/108.22

FOREIGN PATENT DOCUMENTS

JP 2009-014757 A 1/2009

* cited by examiner

*Primary Examiner* — Christopher D Rodee
(74) *Attorney, Agent, or Firm* — Studebaker & Brackett PC

(57) ABSTRACT

A composite core of a toner particle is a composite of a toner core containing a polyester resin and a plurality of resin particles each containing a first resin. A shell layer partially covering a surface of the composite core is a film containing a second resin. The first resin has a glass transition point that is 10° C. or more higher than a glass transition point of the second resin. The plurality of resin particles each have a particle diameter that is 1.5 times or more greater than a thickness of the shell layer. An amount of the resin particles is at least 0.3 parts by mass and no greater than 2.0 parts by mass relative to 100 parts by mass of the toner cores. The resin particles have a positive zeta potential at pH 4.

9 Claims, 3 Drawing Sheets

ELECTROSTATIC LATENT IMAGE DEVELOPING TONER

INCORPORATION BY REFERENCE

The present application claims priority under 35 U.S.C. § 119 to Japanese Patent Application No. 2016-145409, filed on Jul. 25, 2016. The contents of this application are incorporated herein by reference in their entirety.

BACKGROUND

The present disclosure relates to an electrostatic latent image developing toner and particularly relates to a capsule toner.

Toner particles included in a capsule toner each include a core and a shell layer (capsule layer) disposed over a surface of the core. The shell layer covering each core can improve high-temperature preservability of the toner. In an example of a toner, a toner core (core particle) and a shell layer (coat layer) each include a polyester resin.

SUMMARY

An electrostatic latent image developing toner according to the present disclosure includes a plurality of toner particles each including a composite core and a shell layer partially covering a surface of the composite core. The composite core is a composite of a toner core containing a polyester resin and a plurality of resin particles each containing a first resin. The plurality of resin particles each adhere to a surface of the toner core. The shell layer is a film containing a second resin. The first resin has a glass transition point that is 10° C. or more higher than a glass transition point of the second resin. The plurality of resin particles each have a particle diameter that is 1.5 times or more greater than a thickness of the shell layer. An amount of the resin particles is at least 0.3 parts by mass and no greater than 2.0 parts by mass relative to 100 parts by mass of the toner cores. The resin particles have a positive zeta potential at pH 4 measured by laser Doppler electrophoresis.

DETAILED DESCRIPTION

Figure 1:
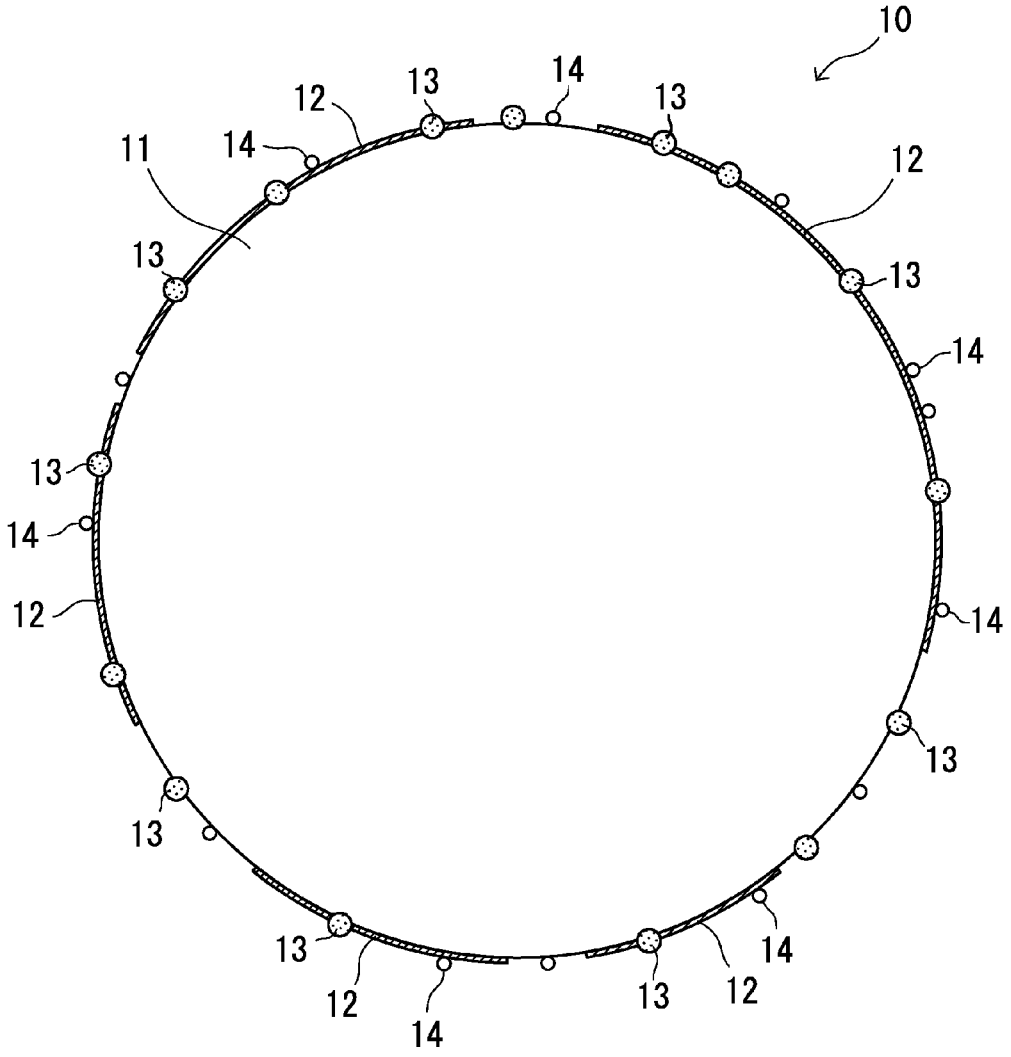
FIG. 1 is a diagram illustrating an example of a cross-sectional structure of a toner particle included in an electrostatic latent image developing toner according to an embodiment of the present disclosure.

The following describes an embodiment of the present disclosure. Evaluation results (for example, values indicating a shape and physical properties) for a powder (specific examples include toner cores, toner mother particles, an external additive, and a toner) are each a number average of values measured for a suitable number of particles included in the powder, unless otherwise stated.

A number average particle diameter of a powder is a number average value of equivalent circular diameters of primary particles of the powder (Heywood diameters: diameters of circles having the same areas as projections of the particles) measured using a microscope, unless otherwise stated. A value for volume median diameter ($D_{50}$) of a powder is measured based on the Coulter principle (electrical sensing zone technique) using "Coulter Counter Multisizer 3" produced by Beckman Coulter, Inc., unless otherwise stated. A value for roundness (=perimeter of a circle having the same area as a projection of a particle/perimeter of the particle) is a number average of values measured for a suitable number of particles (for example, 3,000 particles) using a flow particle imaging analyzer ("FPIA (registered Japanese trademark)-3000" produced by Sysmex Corporation), unless otherwise stated.

A glass transition point (Tg) is measured in accordance with "Japanese Industrial Standard (JIS) K7121-2012" using a differential scanning calorimeter ("DSC-6220" produced by Seiko Instruments Inc.), unless otherwise stated. In a heat absorption curve (vertical axis: heat flow (DSC signal), horizontal axis: temperature) measured using the differential scanning calorimeter during second heating, the glass transition point (Tg) corresponds to a temperature (onset temperature) at a point of change in specific heat (i.e., an intersection point of an extrapolation line of a base line and an extrapolation line of an inclined portion of the curve). A softening point (Tm) is measured using a capillary rheometer ("CFT-500D" produced by Shimadzu Corporation), unless otherwise stated. The softening point (Tm) corresponds to a temperature at a point on an S-shaped curve (horizontal axis: temperature, vertical axis: stroke) measured using the capillary rheometer, at which point, the stroke value is "(base line stroke value+maximum stroke value)/2". An acid value is measured in accordance with "Japanese Industrial Standard (JIS) K0070-1992", unless otherwise stated.

An SP value (SP: solubility parameter, unit: $(cal/cm^3)^{1/2}$, temperature: 25° C.) is calculated according to a calculation method proposed by Fedors (R. F. Fedors, *Polymer Engineering and Science,* 1974, vol. 14, No. 2, pages 147-154), unless otherwise stated. The SP value is represented by an expression "SP value=$(E/V)^{1/2}$" (E: molecular cohesive energy [cal/mol], V: molar volume [$cm^3$/mol]).

Strength of hydrophobicity (or strength of hydrophilicity) can be indicated by for example a contact angle of a water droplet (water wettability). A larger contact angle of a water droplet indicates stronger hydrophobicity.

Strength of chargeability corresponds to ease of triboelectric charging, unless otherwise stated. For example, a toner can be triboelectrically charged by mixing and stirring the toner with a standard carrier (anionic standard carrier: N-01, cationic standard carrier: P-01) provided by The Imaging Society of Japan. Surface potential of a toner particle is measured before and after the triboelectric charging using for example a kelvin probe force microscope (KFM). A portion having a larger change in potential before and after the triboelectric charging has stronger chargeability.

In the following description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Furthermore, the term "(meth)acryl" is used as a generic term for both acryl and methacryl. Also, the term "(meth)acryloyl" is used as a generic term for both acryloyl ($CH_2$=CH—CO—) and methacryloyl ($CH_2$=C($CH_3$)—CO—).

A toner according to the present embodiment can be favorably used for example as a positively chargeable toner for development of an electrostatic latent image. The toner of the present embodiment is a powder including a plurality of toner particles (particles each having features described below). The toner may be used as a one-component developer. Alternatively, the toner may be mixed with a carrier using a mixer (for example, a ball mill) to prepare a two-component developer. In order to form a high-quality image, a ferrite carrier (specifically, a powder of ferrite particles) is preferably used as the carrier. Also, in order to form a high-quality image for an extended period of time, magnetic carrier particles each including a carrier core and a resin layer covering the carrier core are preferably used. In order that carrier particles are magnetic, carrier cores thereof may be formed from a magnetic material (for example, a ferromagnetic material such as ferrite) or a resin in which magnetic particles are dispersed. Alternatively, magnetic particles may be dispersed in the resin layer covering the carrier core. The resin layer is formed from for example at least one resin selected from the group consisting of fluororesins (specific examples include PFA and FEP), polyimide-imide resins, silicone resins, urethane resins, epoxy resins, and phenolic resins. In order to form a high-quality image, an amount of the toner in the two-component developer is preferably at least 5 parts by mass and no greater than 15 parts by mass relative to 100 parts by mass of the carrier. The carrier particles preferably have a particle diameter of at least 20 μm and no greater than 120 μm, and more preferably at least 25 μm and no greater than 80 μm. Note that a positively chargeable toner included in a two-component developer is positively charged by friction with a carrier.

The toner according to the present embodiment can be used for image formation for example in an electrophotographic apparatus (image forming apparatus). The following describes an example of image forming methods performed by electrophotographic apparatuses.

Initially, an image forming section (for example, a charger and a light exposure device) of an electrophotographic apparatus forms an electrostatic latent image on a photosensitive member (for example, on a surface of a photosensitive drum) based on image data. Subsequently, a developing device (specifically, a developing device loaded with a developer including a toner) of the electrophotographic apparatus supplies the toner to the photosensitive member to develop the electrostatic latent image formed on the photosensitive member. The toner is charged by friction with a carrier, a developing sleeve, or a blade in the developing device before being supplied to the photosensitive member. For example, a positively chargeable toner is charged positively. The toner (specifically, the charged toner) on the developing sleeve (for example, on a surface of a development roller in the developing device) disposed in the vicinity of the photosensitive member is supplied to the photosensitive member and adheres to the electrostatic latent image on the photosensitive member. As a result, a toner image is formed on the photosensitive member. Toner is supplied to the developing device from a toner container containing toner for replenishment use to make up for consumed toner.

In a subsequent transfer process, a transfer device of the electrophotographic apparatus transfers the toner image on the photosensitive member to an intermediate transfer member (for example, a transfer belt) and further transfers the toner image from the intermediate transfer member to a recording medium (for example, paper). Thereafter, a fixing device (fixing method: nip fixing in which fixing is performed through a nip between a heating roller and a pressure roller) of the electrophotographic apparatus fixes the toner on the recording medium by applying heat and pressure to the toner. As a result, an image is formed on the recording medium. For example, a full-color image can be formed by superimposing toner images in four different colors: black, yellow, magenta, and cyan. Note that the transfer process may be a direct transfer process by which the toner image on the photosensitive member is transferred directly to the recording medium not via the intermediate transfer member. Also, a belt fixing method may be adopted as a fixing method.

The toner according to the present embodiment is an electrostatic latent image developing toner having features (hereinafter referred to as basic features) described below.

(Basic Features of Toner)

The electrostatic latent image developing toner includes a plurality of toner particles each including a composite core and a shell layer partially covering a surface of the composite core. The composite core is a composite of a toner core containing a polyester resin and a plurality of resin particles each containing a first resin. The plurality of resin particles each adhere to a surface of the toner core. Hereinafter, the plurality of resin particles adhering to the surface of the toner core may each be referred to as a "core external additive particle". The shell layer is a film containing a second resin. The first resin has a glass transition point that is 10° C. or more higher than a glass transition point of the second resin. That is, the glass transition point $Tg_1$ (unit: ° C.) of the first resin and the glass transition point $Tg_2$ (unit: ° C.) of the second resin satisfy a relationship "$Tg_1 \geq Tg_2 + 10$". The plurality of resin particles (core external additive particles) each have a particle diameter that is 1.5 times or more greater than a thickness of the shell layer. That is, in a configuration in which the shell layer has a thickness of 10 nm, the plurality of core external additive particles each have a particle diameter of at least 15 nm. An amount of the resin particles (core external additive particles) is at least 0.3 parts by mass and no greater than 2.0 parts by mass relative to 100 parts by mass of the toner cores. The resin particles (core external additive particles) have a positive zeta potential at pH 4 measured by laser Doppler electrophoresis.

Hereinafter, resin particles that satisfy requirements specified in the above-described basic features (specifically, requirements about the particle diameter, the glass transition point, and the zeta potential) may be referred to as "target particles". In addition to the target particles, a particle that does not satisfy the requirements specified in the above-described basic features may be externally added to the toner core. However, the target particles preferably account for at least 50% by number of all particles externally added to the toner cores (specifically, particles adhering to the surfaces of the toner cores), more preferably at least 90% by number, and particularly preferably 100% by number.

The thickness of the shell layer can be measured through analysis of a transmission electron microscope (TEM) image of a cross section of a toner particle using a commercially available image analysis software (for example, "WinROOF" produced by Mitani Corporation). Note that in a situation in which a shell layer of a toner particle does not have a uniform thickness, thicknesses of the shell layer are measured at four positions equally spaced apart from each other (specifically, four positions at which the shell layer intersects with two orthogonal straight lines intersecting with each other at substantially a center of a cross section of the toner particle), and an arithmetic mean of the thus measured four values is determined to be an evaluation value (the thickness of the shell layer) of the toner particle.

The glass transition point and the zeta potential of the above-described basic features are measured according to the same methods as those used in examples described further below or any suitable alternative method.

An external additive may be caused to adhere to a surface of the shell layer and/or a surface region of the toner core not covered by the shell layer. The external additive may be omitted if unnecessary. Hereinafter, a toner particle prior to adhesion of an external additive will be referred to as a "toner mother particle". Also, a material for forming the shell layer will be referred to as a "shell material".

Sufficient low-temperature fixability of the toner can be easily ensured by inclusion of a polyester resin in the toner core. However, the polyester resin is readily negatively chargeable. Therefore, a toner core containing the polyester resin tends to be readily negatively chargeable. In the toner having the above-described basic features, the resin particles (core external additive particles) have a positive zeta potential at pH 4 measured by laser Doppler electrophoresis. As a result of the core external additive particles adhering to the surface of each toner core, sufficient positive chargeability of the toner can be easily ensured.

The inventor has found that sufficient high-temperature preservability, low-temperature fixability, positive chargeability, and charge retention of the toner can be easily ensured by causing at least 0.3 parts by mass and no greater than 2.0 parts by mass of the resin particles (core external additive particles) to adhere to surfaces of 100 parts by mass of the toner cores. However, the core external additive particles have to satisfy requirements about the particle diameter and the glass transition point described below.

In the toner having the above-described basic features, sufficient high-temperature preservability of the toner can be easily ensured in a configuration in which the resin particles (core external additive particles) adhering to the surface of each toner core each have a particle diameter of 1.5 times or more greater than the thickness of the shell layer. The core external additive particles having the particle diameter sufficiently larger than the thickness of the shell layer are thought to function as spacers among the toner particles to prevent agglomeration of the toner particles. Also, the core external additive particles protruding from the surface of the shell layer toward the outside of each toner particle are thought to be easily frictioned with a carrier in a two-component developer. In order that the toner is excellent in high-temperature preservability, low-temperature fixability, and positive chargeability, the thickness of the shell layer is preferably at least 10 nm and no greater than 40 nm, and the particle diameter of each of the plurality of the resin particles (core external additive particles) is preferably at least 30 nm and no greater than 100 nm. Core external additive particles having a too large particle diameter tend to easily separate from the composite core.

In the toner having the above-described basic features, the first resin (specifically, the resin forming the core external additive particles) has a glass transition point that is 10° C. or more higher than a glass transition point of the second resin (specifically, the resin forming the shell layer). As a result of the resin particles (core external additive particles) having the sufficiently higher glass transition point than the shell layer adhering to the surface of each toner core, charge decay of the toner can be easily inhibited. Although a principle that explains the above has not been found, the inventor presumes that influence of the toner core, which is liable to charge decay, is reduced (or blocked) by the first resin (specifically, the resin forming the core external additive particles) having the sufficiently high glass transition point, resulting in inhibition of charge decay of the toner. In order to favorably inhibit charge decay of the toner while achieving both high-temperature preservability and low-temperature fixability of the toner, the first resin (specifically, the resin forming the core external additive particles) preferably has a glass transition point of at least 70° C. and no greater than 120° C., and the second resin (specifically, the resin forming the shell layer) preferably has a glass transition point of at least 60° C. and no greater than 80° C.

In order to achieve both high-temperature preservability and low-temperature fixability of the toner, it is preferable that the shell layer selectively covers a surface region of the composite core where the resin particles are not present. The shell layer may cover all surface regions of the composite core where the resin particles are not present. Hereinafter, a surface region of the composite core where the resin particles are not present may be referred to as a "non-externally added core region". In a configuration in which the shell layer covers all non-externally added core regions, coverage of the shell layer is substantially determined by an amount of the resin particles (core external additive particles). Therefore, the coverage of the shell layer can be easily adjusted. In order to prevent separation of the shell layer from the toner particle, it is preferable that a bottom portion of each resin particle (core external additive particle) is embedded in the toner core.

In order to achieve both high-temperature preservability and low-temperature fixability of the toner, the shell layer preferably covers at least 70% and no greater than 95% of a surface area of each toner core. In a configuration in which the shell layer covers the surface of each toner core at relatively high coverage, sufficient high-temperature preservability of the toner can be easily ensured. The coverage (unit: %) of the shell layer is represented by an equation "coverage of shell layer=100×(area of covered core region)/(surface area of toner core)". In the equation, "surface area of toner core" corresponds to a sum of a total area of at least one covered core region and a total area of at least one exposed core region. "Covered core region" refers to a surface region of the toner core that is covered by the shell layer, and "exposed core region" refers to a surface region of the toner core that is not covered by the shell layer. Coverage of the shell layer of 100% indicates that the shell layer covers the entire surface area of the toner core. The coverage of the shell layer can be measured by taking an image of a surface of a toner particle (for example, a toner particle dyed in advance) using an electron microscope and analyzing the image using a commercially available image analysis software. The coverage of the shell layer may be measured after external addition. The measurement may be carried out by avoiding an external additive. Alternatively, the measurement may be carried out by removing an external additive adhering to toner mother particles. The external additive may be removed by dissolving the external additive using a solvent (for example, an alkaline solution). Alternatively, the external additive may be removed from toner particles using an ultrasonic cleaner.

The shell layer tends to have weak regions (regions that can be fractured easily) in the vicinities of the core external additive particles. Due to the presence of these fracture points (regions that can be fractured easily) in the shell layer, sufficient low-temperature fixability of the toner can be easily ensured even in a configuration in which the shell layer covers 70% or more of the surface area of each toner core.

Figure 2:
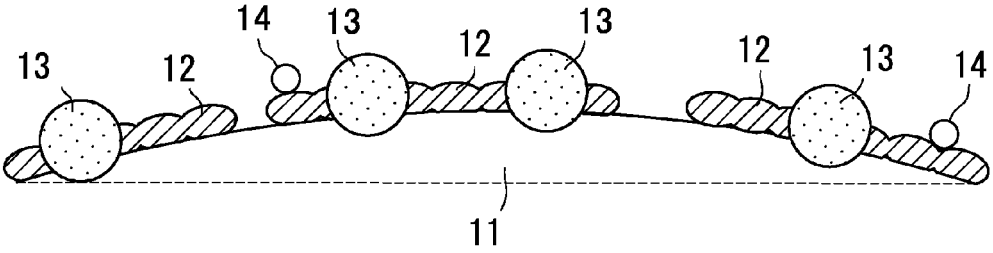
FIG. 2 is an enlarged view of a part of a surface of the toner particle illustrated in FIG. 1.
Figure 3:
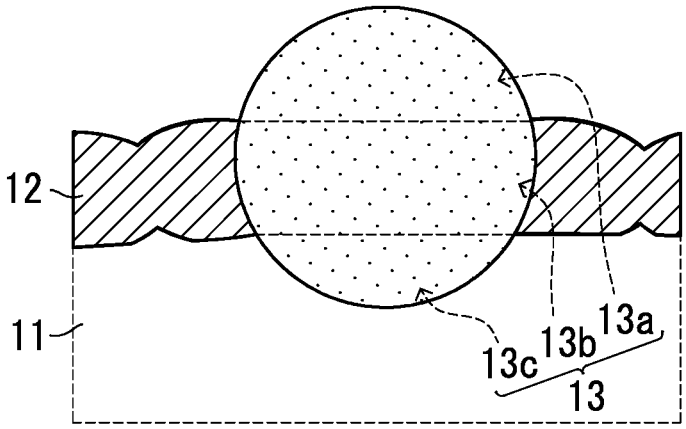
FIG. 3 is an enlarged view of a resin particle a bottom portion of which is embedded in a toner core.

The following describes an example of toner particles included in a toner having the above-described basic features with reference to FIGS. 1 to 3.

A toner particle 10 illustrated in FIG. 1 includes a toner mother particle and an external additive (specifically, a plurality of inorganic particles 14) adhering to a surface of the toner mother particle. The toner mother particle includes a toner core 11, a shell layer 12, and a plurality of resin particles 13.

The shell layer 12 partially covers a surface of the toner core 11. However, as illustrated in FIG. 2, the plurality of resin particles 13 (core external additive particles) adhere to the surface of the toner core 11. The toner core 11 and the resin particles 13 adhering to the surface of the toner core 11 form a composite (that is, a composite core). The shell layer 12 includes a plurality of film fragments. Each film fragment of the shell layer 12 in contact with a resin particle 13 extends around the resin particle 13. The shell layer 12 selectively covers a surface region of the composite core where the resin particles 13 are not present.

As illustrated in FIG. 3, each resin particle 13 includes a top portion 13*a*, a middle portion 13*b*, and a bottom portion 13*c*. The top portion 13*a* is a portion of the resin particle 13 protruding from a surface of the shell layer 12. The top portion 13*a* of the resin particle 13 is exposed from the shell layer 12 without being covered by the shell layer 12. The middle portion 13*b* is a portion of the resin particle 13 in contact with the shell layer 12. The bottom portion 13*c* is a portion of the resin particle 13 embedded in the toner core 11. In the toner particle 10, the top portion 13*a* of the resin particle 13 is located on an outer side (that is, a side far from the toner core 11) of an outer surface of the shell layer 12, and the bottom portion 13*c* of the resin particle 13 is located on an inner side (that is, a side adjacent to the toner core 11) of an inner surface of the shell layer 12. The resin particle 13 extends through the shell layer 12. No resin layer covers the top portion 13*a* of the resin particle 13. For example, when a powder of the toner cores 11 and a resin powder (specifically, a powder including a plurality of the resin particles 13) are stirred together, portions (bottom portions) of the resin particles 13 are embedded in a surface of each toner core 11. Thus, the resin particles 13 adhere (physically bond) to the surface of each toner core 11 by physical force. As a result, composite cores are obtained. Thereafter, the shell layer is formed on each composite core to obtain toner mother particles. In each toner mother particle, the resin particles 13 each include the top portion 13*a*, the middle portion 13*b*, and the bottom portion 13*c* as described above. The shell layer 12 may be formed in a gap between the toner core 11 and the resin particle 13 (specifically, between the bottom portion 13*c* of the resin particle 13 and the toner core 11). The shell layer 12 can be formed in the gap between the toner core 11 and the resin particle 13 for example by dissolving a water-soluble shell material in an aqueous medium and causing the shell material to cure in the aqueous medium that contains the shell material and the composite cores. The resin particles 13 each have a particle diameter that is 1.5 times or more greater than a thickness of the shell layer 12. The resin particles 13 protrude from the surface of the shell layer 12 toward the outside of the toner particle. The resin particles 13 for example have a spherical shape. However, the resin particles 13 may have any shape as long as the resin particles 13 are particles.

In order to ensure both sufficient chargeability and sufficient fluidity of the toner, it is preferable that: the toner having the above-described basic features further includes a powder of inorganic particles as an external additive; the resin particles (specifically, core external additive particles) are fixed on the surface of each toner core mainly by mechanical bonding force due to embedment; and the inorganic particles as the external additive are fixed on a surface of each toner mother particle mainly by Van der Waals force or electrostatic force. Inorganic particles having a relatively small particle diameter can be fixed on the surface of each toner mother particle (the surface of the toner core, the surface of the shell layer, or a surface of the resin particle) by Van der Waals force or electrostatic force without being embedded in the toner mother particle. For example, when a mixture including a powder of the toner mother particles and a powder of inorganic particles having a number average primary particle diameter of at least 10 nm and no greater than 30 nm is mixed, the powder of the inorganic particles adheres to the surface of each toner mother particle. The powder of the inorganic particles is thought to adhere to the surface of each toner mother particle mainly by Van der Waals force or electrostatic force. Silica particles are particularly preferable as the inorganic particles.

In order that the shell layer has a preferable configuration, roundness of the toner mother particles is preferably at least 0.965 and no greater than 0.975.

In order to achieve both high-temperature preservability and low-temperature fixability of the toner, the toner cores preferably have a volume median diameter ($D_{50}$) of at least 4 μm and no greater than 9 μm.

The following describes preferable configurations of each toner particle. The toner core contains a binder resin. The toner core may contain an internal additive (for example, at least one of a releasing agent, a colorant, a charge control agent, and a magnetic powder) as necessary in addition to the binder resin.

[Toner Core]

(Binder Resin)

Typically, the binder resin is a main component (for example, at least 85% by mass) of the toner core. Properties of the binder resin are therefore thought to have great influence on properties of the toner core as a whole. The properties (specific examples include a hydroxyl value, an acid value, Tg, and Tm) of the binder resin can be adjusted by using a combination of a plurality of resins as the binder resin. In a configuration in which the binder resin has an ester group, a hydroxyl group, an ether group, an acid group, or a methyl group, the toner core has strong tendency to be anionic. In a configuration in which the binder resin has an amino group or an amide group, the toner core has strong tendency to be cationic.

The binder resin is preferably a polyester resin, and particularly preferably a polyester resin that contains at least one bisphenol as an alcoholic component. A polyester resin can be obtained through condensation polymerization of at least one polyhydric alcohol and at least one polybasic carboxylic acid. Examples of alcohols that can be preferably used in synthesis of a polyester resin include dihydric alcohols (specific examples include aliphatic diols and bisphenols) and tri- or higher-hydric alcohols listed below. Examples of carboxylic acids that can be preferably used in synthesis of a polyester resin include dibasic carboxylic acids and tri- or higher-basic carboxylic acids listed below.

Examples of preferable aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecandiol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, suberic acid, azelaic acid, sebacic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecylsuccinic acid), alkenylsuccinic acids (specific examples include n-butenylsuccinic acid, isobutenylsuccinic acid, n-octenylsuccinic acid, n-dodecenylsuccinic acid, and isododecenylsuccinic acid), maleic acid, fumaric acid, citraconic acid, itaconic acid, glutaconic acid, and cyclohexanedicarboxylic acid.

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

For example, a polyester resin having an SP value of at least 10.0 $(cal/cm^3)^{1/2}$ and no greater than 12.5 $(cal/cm^3)^{1/2}$ is preferable. Examples of preferable polyester resins include a non-crystalline polyester resin that contains, as an alcoholic component, at least one bisphenol (for example, bisphenol A ethylene oxide adduct and/or bisphenol A propylene oxide adduct) and, as an acid component, an aromatic dicarboxylic acid (for example, terephthalic acid) and/or an unsaturated dicarboxylic acid (for example, fumaric acid).

In a situation in which a polyester resin is used as the binder resin of the toner core, the polyester resin preferably has a number average molecular weight (Mn) of at least 1,000 and no greater than 2,000 in order to ensure sufficient strength of the toner core and sufficient fixability of the toner. Molecular weight distribution (a ratio (Mw/Mn) of a mass average molecular weight (Mw) to the number average molecular weight (Mn)) of the polyester resin is preferably at least 9 and no greater than 21.

In addition to the polyester resin, other resin may be contained in the toner core. Examples of resins other than the polyester resin that can be preferably used as the binder resin include thermoplastic resins such as styrene-based resins, acrylic acid-based resins (specific examples include acrylic acid ester polymers and methacrylic acid ester polymers), olefin-based resins (specific examples include polyethylene resins and polypropylene resins), vinyl chloride resins, polyvinyl alcohols, vinyl ether resins, N-vinyl resins, polyamide resins, and urethane resins. Also, copolymers of the above-listed resins, that is, copolymers obtained by introducing a repeating unit into the above-listed resins (specific examples include styrene-acrylic acid-based resins and styrene-butadiene-based resins) can be preferably used as the binder resin.

(Colorant)

The toner core may contain a colorant. A known pigment or dye that matches the color of the toner can be used as the colorant. In order that the toner is suitable for image formation, an amount of the colorant is preferably at least 0.1 parts by mass and no greater than 50 parts by mass relative to 100 parts by mass of the binder resin.

The toner core may contain a black colorant. Carbon black is an example of the black colorant. Alternatively, a colorant that is adjusted to a black color using a yellow colorant, a magenta colorant, and a cyan colorant may be used as the black colorant. A magnetic powder described further below may be used as the black colorant.

The toner core may contain a non-black colorant such as a yellow colorant (specific examples include Naphthol Yellow, Monoazo Yellow, Diazo Yellow, Disazo Yellow, and anthraquinone compounds), a magenta colorant (specific examples include quinacridone compounds, naphthol compounds, Carmine 6B, and Monoazo Red), or a cyan colorant (specific examples include Phthalocyanine Blue and anthraquinone compounds).

(Releasing Agent)

The toner core may contain a releasing agent. The releasing agent is used for example in order to improve fixability of the toner or resistance of the toner to being offset. In order to improve fixability of the toner or resistance of the toner to being offset, an amount of the releasing agent is preferably at least 1 part by mass and no greater than 10 parts by mass relative to 100 parts by mass of the binder resin.

A wax is preferably used as the releasing agent in the toner core. Examples of waxes include ester wax, polyethylene wax, polypropylene wax, fluororesin wax, Fischer-Tropsch wax, paraffin wax, and montan wax. In order to improve fixability of the toner and resistance of the toner to being offset, an ester wax is preferably used. Examples of ester waxes include natural ester waxes (for example, carnauba wax and rice wax) and synthetic ester waxes. In a configuration in which the toner core contains a polyester resin as the binder resin, it is particularly preferable that the toner core contains an ester wax (for example, carnauba wax) or a polyethylene wax as the releasing agent. One releasing agent may be used alone, or two or more releasing agents may be used in combination.

(Charge Control Agent)

The toner core may contain a charge control agent. The charge control agent is used for example in order to improve charge stability or a charge rise characteristic of the toner. The charge rise characteristic of the toner is an indicator as to whether the toner can be charged to a specific charge level in a short period of time.

Anionic strength of the toner core can be increased by including a negatively chargeable charge control agent (specific examples include organic metal complexes and chelate compounds) in the toner core. Cationic strength of the toner core can be increased by including a positively chargeable charge control agent (specific examples include pyridine, nigrosine, and quaternary ammonium salts) in the toner core. However, when sufficient chargeability of the toner is ensured, the toner core need not contain a charge control agent.

(Magnetic Powder)

The toner core may contain a magnetic powder. Examples of materials of the magnetic powder that can be preferably used include ferromagnetic metals (specific examples include iron, cobalt, and nickel, and alloys containing at least one of these metals), ferromagnetic metal oxides (specific examples include ferrite, magnetite, and chromium dioxide), and materials subjected to ferromagnetization (specific examples include carbon materials to which ferromagnetism is imparted through thermal treatment). One magnetic powder may be used alone, or two or more magnetic powders may be used in combination.

In order to impart sufficient magnetism uniformly to the toner core, the magnetic powder preferably has a particle diameter of at least 0.1 μm and no greater than 1.0 μm. In order to inhibit elution of metal ions (for example, iron ions) from the magnetic powder, surface treatment is preferably performed on the magnetic powder (specifically, surfaces of magnetic particles included in the magnetic powder) using a surface treatment agent (specific examples include silane coupling agents and titanate coupling agents).

[Core External Additive Particle]

In the toner having the above-described basic features, each toner particle includes a composite core and a shell layer covering a surface of the composite core. In the composite core, a plurality of core external additive particles (resin particles each containing a first resin) adhere to a surface of the toner core.

The first resin (specifically, the resin forming the core external additive particles) preferably includes a repeating unit derived from a vinyl compound. A desired property can be imparted to the toner easily and surely by preparing the resin particles (specifically, the resin particles containing the first resin) through polymerization of a vinyl compound having a functional group that is suitable for the property to be imparted to the toner. Note that the repeating unit derived from the vinyl compound is thought to be addition polymerized through carbon-to-carbon double bonds "C=C" in the resin. The vinyl compound refers to a compound having a vinyl group ($CH_2$=CH—) or a substituted vinyl group in which hydrogen is replaced. Examples of vinyl compounds include ethylene, propylene, butadiene, vinyl chloride, acrylic acid, acrylic acid ester, methacrylic acid, methacrylic acid ester, acrylonitrile, and styrene.

In order to improve positive chargeability of the toner, the first resin (specifically, the resin forming the core external additive particles) is preferably a polymer of monomers (resin raw materials) including a (meth)acryloyl group-containing quaternary ammonium compound. Examples of preferable (meth)acryloyl group-containing quaternary ammonium compounds include (meth)acrylamidoalkyltrimethylammonium salts (specific examples include (3-acrylamidopropyl)trimethylammonium chloride) and (meth) acryloyloxyalkyltrimethylammonium salts (specific examples include 2-(methacryloyloxy)ethyltrimethylammonium chloride).

In order to improve positive chargeability of the toner, the first resin (specifically, the resin forming the core external additive particles) is particularly preferably a polymer of monomers (resin raw materials) including a (meth)acrylamidoalkyltrimethylammonium salt and at least one acrylic acid-based monomer (for example, two acrylic acid-based monomers: methyl methacrylate and butyl acrylate). For example, in a configuration in which the first resin is a copolymer of at least one (meth)acrylamidoalkyltrimethylammonium salt and at least one acrylic acid-based monomer, an increase in an amount (blending ratio) of the at least one (meth)acrylamidoalkyltrimethylammonium salt relative to an amount of the at least one acrylic acid-based monomer tends to cause an increase in glass transition point (Tg) of the first resin.

Examples of preferable acrylic acid-based monomers include (meth)acrylic acid, (meth)acrylonitrile, (meth) acrylic acid alkyl esters, and (meth)acrylic acid hydroxyalkyl esters. Examples of preferable (meth)acrylic acid alkyl esters include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Examples of preferable (meth)acrylic acid hydroxyalkyl esters include 2-hydroxyethyl (meth)acrylate, 3-hydroxypropyl (meth)acrylate, 2-hydroxypropyl (meth) acrylate, and 4-hydroxybutyl (meth)acrylate.

In order that the toner is suitable for image formation, the first resin particularly preferably includes a repeating unit represented by formula (1) shown below and a repeating unit represented by formula (2) shown below.

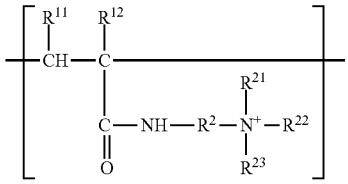

(1)

In formula (1), $R^{11}$ and $R^{12}$ each represent, independently of one another, a hydrogen atom, a halogen atom, or an optionally substituted alkyl group. $R^{21}$, $R^{22}$, and $R^{23}$ each represent, independently of one another, a hydrogen atom, an optionally substituted alkyl group, or an optionally substituted alkoxy group. $R^2$ represents an optionally substituted alkylene group. Preferably, $R^{11}$ and $R^{12}$ each represent, independently of one another, a hydrogen atom or a methyl group. Particularly preferably, $R^{11}$ and $R^{12}$ are a combination of $R^{11}$ representing a hydrogen atom and $R^{12}$ representing a hydrogen atom or a methyl group. Preferably, $R^{21}$, $R^{22}$, and $R^{23}$ each represent, independently of one another, an alkyl group having a carbon number of at least 1 and no greater than 8, and particularly preferably a methyl group, an ethyl group, an n-propyl group, an iso-propyl group, an n-butyl group, or an iso-butyl group. $R^2$ preferably represents an alkylene group having a carbon number of at least 1 and no greater than 6, and particularly preferably represents a methylene group, an ethylene group, or a propylene group. Note that in a repeating unit derived from (3-acrylamidopropyl)trimethylammonium chloride, $R^{11}$ represents a hydrogen atom, $R^{12}$ represents a hydrogen atom, $R^2$ represents a propylene group (—$(CH_2)_3$—), and $R^{21}$ to $R^{23}$ each represent a methyl group. Also, a quaternary ammonium cation ($N^+$) forms a salt through ionic bonding to chlorine (Cl).

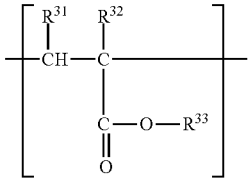

(2)

In formula (2), $R^{31}$ and $R^{32}$ each represent, independently of one another, a hydrogen atom, a halogen atom, or an optionally substituted alkyl group. $R^{33}$ represents a hydrogen atom or an optionally substituted alkyl group. Preferably, $R^{31}$ and $R^{32}$ each represent, independently of one another, a hydrogen atom or a methyl group. Particularly preferably, $R^{31}$ and $R^{32}$ are a combination of $R^{31}$ representing a hydrogen atom and $R^{32}$ representing a hydrogen atom or a methyl group. $R^{33}$ particularly preferably represents a hydrogen atom or an alkyl group having a carbon number of at least 1 and no greater than 4. Note that in a repeating unit derived from methyl methacrylate, $R^{31}$ represents a hydrogen atom and $R^{32}$ and $R^{33}$ each represent a methyl group.

[Shell Layer]

In the toner having the above-described basic features, the toner core and the resin particles adhering to the surface of the toner core form a composite (composite core). The shell layer covers a surface of the composite core. The shell layer may be a film with no granular appearance, or a film with granular appearance. In a situation in which resin particles are used as a shell material, if the material (resin particles) has been completely melted before curing in the form of a film, the resultant shell layer is probably formed as a film with no granular appearance. By contrast, if the material (resin particles) has not been completely melted before curing in the form a film, the resultant shell layer is probably formed as a film in which the resin particles are two-dimensionally arranged (namely, a film with granular appearance). Resin particles can be melted to form a film for example by causing the resin particles to adhere to the surface of each toner core in a liquid and heating the liquid. However, resin particles may be formed into a film by being heated in a drying process or receiving physical impact force in an external addition process. All part of the shell layer is not necessarily formed integrally. The shell layer may be a single film, or an aggregate of a plurality of film fragments (islands) separate from one another.

The shell layer is a film containing a second resin. Preferably, the second resin is for example a thermoplastic resin. In order to achieve both high-temperature preservability and low-temperature fixability of the toner, the shell layer is particularly preferably a film substantially formed from a thermoplastic resin only.

In order to ensure sufficient chargeability of the toner even in an environment of high temperature and high humidity, it is preferable that the first resin is more readily positively chargeable than the second resin and the second resin is more hydrophobic than the first resin. In a configuration in which the plurality of core external additive particles are each more readily positively chargeable than the shell layer and the shell layer is more hydrophobic than the core external additive particles, the shell layer inhibits charge decay of the toner and the core external additive particles ensure sufficient positive chargeability of the toner.

In order to achieve both high-temperature preservability and low-temperature fixability of the toner, the second resin (specifically, the resin forming the shell layer) is preferably a polymer of monomers (resin raw materials) including a styrene-based monomer (specific examples include styrene) and a (meth)acrylic acid alkyl ester (specific examples include butyl acrylate). For example, in a configuration in which the second resin is a copolymer of at least one styrene-based monomer and at least one (meth)acrylic acid alkyl ester, an increase in an amount (blending ratio) of the at least one (meth)acrylic acid alkyl ester relative to an amount of the at least one styrene-based monomer tends to cause a decrease in glass transition point (Tg) of the second resin.

In order that the shell layer has sufficiently strong hydrophobicity and a desired degree of strength, it is preferable that a styrene-based monomer has a largest mole fraction among all monomers of the second resin forming the shell layer.

In order to sufficiently inhibit adsorption of moisture in the air to the surface of the shell layer, it is preferable that 10% by mass or less of all repeating units included in the second resin are repeating units having a hydrophilic functional group, and it is particularly preferable that the second resin includes no repeating unit having a hydrophilic functional group. Hydrophilic functional groups include acid groups (specific examples include carboxyl group and sulfo group), hydroxyl groups, and salts of these groups (specific examples include —COONa, —$SO_3$Na, and —ONa).

Examples of preferable styrene-based monomers include styrene, alkylstyrenes (specific examples include α-methylstyrene, p-ethylstyrene, and 4-tert-butylstyrene), p-hydroxy styrene, m-hydroxy styrene, α-chlorostyrene, o-chlorostyrene, m-chlorostyrene, and p-chlorostyrene.

Examples of preferable (meth)acrylic acid alkyl esters include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate.

In order that the toner is suitable for image formation, the second resin particularly preferably includes a repeating unit represented by formula (3) shown below.

(3)

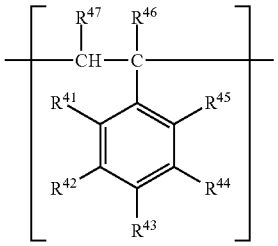

In formula (3), $R^{41}$ to $R^{45}$ each represent, independently of one another, a hydrogen atom, a halogen atom, a hydroxyl group, an optionally substituted alkyl group, an optionally substituted alkoxy group, or an optionally substituted aryl group. $R^{46}$ and $R^{47}$ each represent, independently of one another, a hydrogen atom, a halogen atom, or an optionally substituted alkyl group. Preferably, $R^{41}$ to $R^{45}$ each represent, independently of one another, a hydrogen atom, a halogen atom, an alkyl group having a carbon number of at least 1 and no greater than 4, an alkoxy group having a carbon number of at least 1 and no greater than 4, or an alkoxyalkyl group having a carbon number (specifically, a total number of carbon atoms included in alkoxy and alkyl) of at least 2 and no greater than 6. Preferably, $R^{46}$ and $R^{47}$ each represent, independently of one another, a hydrogen atom or a methyl group. Particularly preferably, $R^{46}$ and $R^{47}$ are a combination of $R^{47}$ representing a hydrogen atom and $R^{46}$ representing a hydrogen atom or a methyl group. Note that in a repeating unit derived from styrene, $R^{41}$ to $R^{47}$ each represent a hydrogen atom.

In order that the toner is suitable for image formation, it is particularly preferable that the second resin further includes a unit derived from a (meth)acrylic acid alkyl ester (specifically, an addition polymerization unit of a (meth) acrylic acid alkyl ester) in addition to the repeating unit represented by the above formula (3).

[External Additive]

An external additive (specifically, a powder including a plurality of external additive particles) may be caused to adhere to the surface of each toner mother particle. Unlike an internal additive, the external additive is not present inside the toner mother particle and is selectively present only on the surface of the toner mother particle (i.e., in a surface portion of the toner particle). The external additive adheres to the surface of each toner mother particle for example when the toner mother particles (powder) and the external additive (powder) are stirred together. The toner mother particle does not chemically react with the external additive particles. The toner mother particle and the external additive particles bond together physically not chemically. Bonding strength between the toner mother particle and the external additive particles can be adjusted by controlling conditions of stirring (specific examples include a stirring time and a rotational speed for stirring) and a particle size, shape, and surface conditions of the external additive particles.

The external additive is used for example in order to improve fluidity or handleability of the toner. In order that the external additive sufficiently exhibits its function while preventing separation of the external additive particles from the toner particles, an amount of the external additive (in a situation in which two or more external additives are used, a total amount of the external additives) is preferably at least 0.5 parts by mass and no greater than 10 parts by mass relative to 100 parts by mass of the toner mother particles.

The external additive particles are preferably inorganic particles, and particularly preferably silica particles or particles of metal oxides (specific examples include alumina, titanium oxide, magnesium oxide, zinc oxide, strontium titanate, and barium titanate). Alternatively or additionally, particles of an organic acid compound such as a fatty acid metal salt (specific examples include zinc stearate) or resin particles may be used as the external additive particles. One type of external additive particles may be used alone, or two or more types of external additive particles may be used in combination.

Surface treatment may be performed on the external additive particles. For example, in a situation in which silica particles are used as the external additive particles, hydrophobicity and/or positive chargeability may be imparted to surfaces of the silica particles using a surface treatment agent. Examples of surface treatment agents that can be preferably used include coupling agents (specific examples include silane coupling agents, titanate coupling agents, and aluminate coupling agents) and silicone oils (specific examples include dimethylsilicone oil). Silane compounds (specific examples include methyltrimethoxysilane and aminosilane) and silazane compounds (specific examples include hexamethyldisilazane (HMDS)) may be used as silane coupling agents. When a surface of a silica base (untreated silica particle) is treated using the surface treatment agent, a large number of hydroxyl groups (—OH) on the surface of the silica base are partially or entirely replaced by functional groups derived from the surface treatment agent. As a result, silica particles having the functional groups derived from the surface treatment agent (specifically, functional groups that are more hydrophobic and/or more readily positively chargeable than the hydroxyl groups) on surfaces thereof are obtained.

[Method for Producing Toner]

In order to produce the toner having the above-described basic features easily and favorably, the toner is preferably produced for example by the following method including a toner core preparation process, a core external addition process, and a shell layer formation process.

(Toner Core Preparation Process)

Examples of preferable methods for preparing toner cores include a pulverization method and an aggregation method. Sufficient dispersion of an internal additive in a binder resin can be easily achieved by these methods.

In an example of the pulverization method, a binder resin, a colorant, a charge control agent, and a releasing agent are initially mixed. Then, the resultant mixture is melt-kneaded using a melt-kneading device (for example, a single-screw or twin-screw extruder). Then, the resultant melt-kneaded product is pulverized, and the resultant pulverized product is classified. Through the above, toner cores are obtained. The pulverization method is usually a more easy method for preparing toner cores than the aggregation method.

In an example of the aggregation method, a binder resin, a releasing agent, and a colorant each in the form of fine particles are initially caused to aggregate in an aqueous medium to form particles having a desired particle diameter. Through the above, aggregated particles containing components of the binder resin, the releasing agent, and the colorant are formed. Subsequently, the aggregated particles are heated to cause coalescence of the components contained in the aggregated particles. Through the above, toner cores having a desired particle diameter are obtained.

(Core External Addition Process)

First resin particles (specifically, resin particles substantially formed from the first resin) are fixed on the surface of each toner core. The first resin is for example a polymer of monomers (resin raw materials) including a (meth)acryloyl group-containing quaternary ammonium compound. Examples of methods for fixing the first resin particles on the surface of each toner core include mixing the toner cores (powder) and a resin powder (specifically, a powder including a plurality of the first resin particles) using a mixer (specific examples include an FM mixer produced by Nippon Coke & Engineering Co., Ltd., a multipurpose mixer produced by Nippon Coke & Engineering Co., Ltd., and a Nauta mixer (registered Japanese trademark) produced by Hosokawa Micron Corporation). When the toner cores (powder) and the resin powder are stirred together, bottom portions of the first resin particles are embedded in the surface of each toner core. As a result, composite cores (that are each a composite of the toner core and the first resin particles) are obtained.

Note that the FM mixer includes a mixing vessel equipped with a temperature control jacket. The FM mixer further includes a deflector, a temperature sensor, an upper screw, and a lower screw, which are provided in the mixing vessel. When materials (more specifically, powders or slurries) loaded into the mixing vessel of the FM mixer are mixed, the materials in the mixing vessel are caused to flow in an up-and-down direction while swirling by rotation of the lower screw. As a result, a convective flow of the materials is generated in the mixing vessel. Shear force is applied to the materials by the upper screw rotating at a high speed. The FM mixer is capable of mixing the materials with strong mixing force by applying the shear force to the materials.

(Shell Layer Formation Process)

Next, a shell layer is formed on the surface of each composite core. The following describes an example of preferable methods for forming the shell layer. Note that in order to inhibit dissolution or elution of toner core components (particularly, the binder resin and the releasing agent) during formation of the shell layer, the shell layer is preferably formed in an aqueous medium. The aqueous medium is a medium of which a main component is water (specific examples include pure water and a liquid mixture of water and a polar medium). The aqueous medium may function as a solvent. A solute may be dissolved in the aqueous medium. The aqueous medium may function as a dispersion medium. A dispersoid may be dispersed in the aqueous medium. Examples of polar mediums that can be used in the aqueous medium include alcohols (specific examples include methanol and ethanol). The aqueous medium has a boiling point of approximately 100° C.

Initially, a weakly acidic aqueous medium (having a pH within a range for example from 3 to 5) is prepared by adding an acidic substance (for example, an aqueous solution of p-toluenesulfonic acid) to ion exchanged water. Then, the composite cores and a shell material are added to the aqueous medium. The composite cores and the shell material may be added in any order. For example, the shell material may be added prior to addition of the composite cores. Alternatively, the composite cores and the shell material may be added simultaneously. A suspension of second resin particles (specifically, resin particles substantially formed from the second resin) is for example added as the shell material. The second resin is for example a polymer of monomers (resin raw materials) including a styrene-based monomer and a (meth)acrylic acid alkyl ester. The first resin particles are more readily positively chargeable than the second resin particles. The second resin particles are more hydrophobic than the first resin particles.

Note that an amount of the shell material appropriate to form the shell material with a desired thickness can be calculated based on for example a specific surface area of the composite core. Also, a polymerization accelerator may be added to the liquid.

In order to cause the shell material to uniformly adhere to the surfaces of the composite cores, it is preferable to achieve a high degree of dispersion of the composite cores in the liquid containing the shell material. In order to achieve a high degree of dispersion of the composite cores in the liquid, a surfactant may be added to the liquid or the liquid may be stirred using a powerful stirrer (for example, "Hivis Disper Mix" produced by PRIMIX Corporation). In a situation in which the composite cores are anionic, agglomeration of the composite cores can be prevented by using an anionic surfactant having the same polarity. Examples of surfactants that can be used include sulfate ester salt surfactants, sulfonic acid salt surfactants, phosphate ester salt surfactants, and soaps.

Subsequently, a temperature of the liquid containing the composite cores and the shell material is increased up to a predetermined retention temperature (for example, at least 40° C. and no greater than 95° C.) at a predetermined rate (for example, at least 0.05° C./minute and no greater than 3.5° C./minute) while the liquid is stirred. The temperature of the liquid is maintained at the retention temperature for a predetermined time period (for example, at least 30 minutes and no longer than 4 hours) while the liquid is stirred. Solidification of the shell material (formation of the shell layer) on each composite core is thought to proceed while the liquid is maintained at a high temperature (or while the liquid is heated). The shell material bonds to the toner cores to form the shell layer. As a result of the second resin particles being melted (or deformed) in the liquid by heating, a resin film (that is, the shell layer) is formed. When the shell layer is formed on the surface of each composite core in the liquid, a dispersion of toner mother particles is obtained. Note that the first resin particles (core external additive particles) each maintain the shape of a particle on the surface of each toner core. Formation of the film from the shell material (second resin particles) is caused to proceed until the resultant shell layer has a thickness not greater than ⅔ of a particle diameter of the first resin particles (core external additive particles). As a result of the second resin particles being sufficiently formed into a film, the toner mother particles are obtained.

The second resin particles can be melted (or deformed) to form a film by causing the second resin particles to adhere to the surface of each composite core in the liquid and heating the liquid, as described above. However, the second resin particles may be formed into a film by being heated in a drying process or receiving physical impact force in a shell external addition process.

Subsequently, the dispersion of the toner mother particles is neutralized using for example sodium hydroxide. Then, the dispersion of the toner mother particles is cooled to for example room temperature (approximately 25° C.). Subsequently, the dispersion of the toner mother particles is filtered for example using a Buchner funnel. As a result, the toner mother particles are separated (solid-liquid separated) from the liquid and a wet cake of the toner mother particles is obtained. Subsequently, the toner mother particles are washed for example by dispersing the toner mother particles in water and filtering the resultant dispersion, repeatedly. Subsequently, the washed toner mother particles are dried. The toner mother particles may be dried using for example a spray dryer, a fluidized bed dryer, a vacuum freeze dryer, or a reduced pressure dryer. Thereafter, external addition to the toner mother particles (specifically, a shell external addition process) may be performed as necessary. In the shell external addition process, the toner mother particles and an external additive (for example, silica particles) are mixed for example using a mixer (specific examples include an FM mixer produced by Nippon Coke & Engineering Co., Ltd.) to cause the external additive to adhere to the surface of each toner mother particle. Note that in a situation in which the spray dryer is used in the drying process, the drying process and the shell external addition process can be performed simultaneously by spraying a dispersion of the external additive (for example, silica particles) to the toner mother particles. Through the above, a toner including a large number of toner particles is obtained.

Details and order of the processes in the above-described method for producing the toner may be altered as appropriate in accordance with desired structure or properties of the toner. For example, the shell material may be added to the liquid as a single addition or may be divided up and added to the liquid as a plurality of additions. The toner may be sifted after the external addition process. Non-essential processes may be omitted. For example, in a situation in which a commercially available product can be used directly as a material, use of the commercially available product can omit a process of preparing the material. In a situation in which reaction for forming the shell layer progresses favorably even without pH adjustment of the liquid, a process of pH adjustment may be omitted. If an external additive is unnecessary, the shell external addition process may be omitted. In a situation in which an external additive is not caused to adhere to the surfaces of the toner mother particles (the shell external addition process is omitted), the toner mother particles are equivalent to the toner particles. A prepolymer may be used as necessary instead of a monomer as a material for synthesizing a resin. In order to obtain a specific compound, a salt, ester, hydrate, or anhydride of the compound may be used as a raw material. Preferably, a large number of the toner particles are produced at the same time in order to produce the toner efficiently. The toner particles produced at the same time are thought to have substantially the same structure.

EXAMPLES

The following describes examples of the present disclosure. Table 1 shows toners TA-1 to TA-8 and TB-1 to TB-5 (electrostatic latent image developing toners) according to examples and comparative examples. Table 2 shows core external additive particles (resin particles SB-1 to SB-5) used in production of the toners shown in Table 1.

TABLE 1

| | Resin particle (Core external additive particle) | | Shell material | Shell layer Thickness | |
|---|---|---|---|---|---|
| Toner | Type | Amount [g] | Amount [g] | (shell thickness) [nm] | Tg [° C.] |
| TA-1 | SB-1 | 10 | 37.0 | 20 | 71 |
| TA-2 | SB-1 | 5 | 37.0 | 20 | 71 |
| TA-3 | SB-1 | 15 | 37.0 | 20 | 71 |
| TA-4 | SB-1 | 20 | 37.0 | 20 | 71 |
| TA-5 | SB-1 | 10 | 18.5 | 10 | 71 |
| TA-6 | SB-1 | 10 | 55.5 | 30 | 71 |
| TA-7 | SB-1 | 10 | 74.0 | 40 | 71 |
| TA-8 | SB-2 | 10 | 37.0 | 20 | 71 |
| TB-1 | SB-1 | 25 | 37.0 | 20 | 71 |
| TB-2 | SB-1 | 10 | 92.5 | 50 | 71 |
| TB-3 | SB-3 | 10 | 37.0 | 20 | 71 |
| TB-4 | SB-4 | 10 | 74.0 | 40 | 71 |
| TB-5 | SB-5 | 10 | 37.0 | 20 | 71 |

TABLE 2

| Resin particle | Particle diameter [nm] | Glass transition point [° C.] | Zeta potential (pH 4) [mV] |
|---|---|---|---|
| SB-1 | 62 | 86 | +20 |
| SB-2 | 55 | 103 | +28 |
| SB-3 | 55 | 59 | +14 |
| SB-4 | 32 | 102 | +25 |
| SB-5 | 65 | 84 | −10 |

The following describes a production method, evaluation methods, and evaluation results of the toners TA-1 to TA-8 and TB-1 to TB-5 in order. In evaluations in which errors may occur, an arithmetic mean of an appropriate number of measured values was determined to be an evaluation value in order to ensure that any errors were sufficiently small. A number average primary particle diameter (average equivalent circular diameter) was determined from a projection image of particles taken using a transmission electron microscope (TEM). A glass transition point (Tg) was measured according to a method described below.

<Method for Measuring Tg>

A differential scanning calorimeter ("DSC-6220" produced by Seiko Instruments Inc.) was used as a measuring device. A glass transition point (Tg) of a sample was determined by plotting a heat absorption curve of the sample using the measuring device. Specifically, about 10 mg of the sample (for example, a resin) was placed in an aluminum pan (aluminum container) and the aluminum pan was set in a measurement section of the measuring device. Also, an empty aluminum pan was used as a reference. In plotting the heat absorption curve, a temperature of the measurement section was increased from a measurement starting temperature of 25° C. to 200° C. at a rate of 10° C./minute (RUN1). Thereafter, the temperature of the measurement section was decreased from 200° C. to 25° C. at a rate of 10° C./minute. Subsequently, the temperature of the measurement section was increased again from 25° C. to 200° C. at a rate of 10° C./minute (RUN2). The heat absorption curve (vertical axis: heat flow (DSC signal), horizontal axis: temperature) of the sample was plotted in RUN2. Tg of the sample was read from the plotted heat absorption curve. The glass transition point (Tg) corresponds to a temperature (onset temperature) at a point of change in specific heat on the heat absorption curve (i.e., an intersection point of an extrapolation line of a base line and an extrapolation line of an inclined portion of the curve).

[Preparation of Materials]

(Shell Material: Preparation of Suspension SA)

A 1-L three-necked flask equipped with a thermometer and a stirring impeller was set in a water bath at a temperature of 30° C. and charged with 815 mL of ion exchanged water and 75 mL of a cationic surfactant ("QUARTAMIN (registered Japanese trademark) 24P" produced by Kao Corporation, 25% by mass aqueous solution of lauryltrimethylammonium chloride). Thereafter, a temperature inside the flask was increased to 80° C. using the water bath. Subsequently, two liquids (a first liquid and a second liquid) were each dripped into the flask contents at the temperature of 80° C. over 5 hours. The first liquid was a liquid mixture of 68 mL of styrene and 12 mL of n-butyl acrylate. The second liquid was a solution obtained by dissolving 0.5 g of potassium peroxodisulfate in 30 mL of ion exchanged water. Subsequently, the temperature inside the flask was maintained at 80° C. for 2 hours to polymerize the flask contents. As a result, a suspension (hereinafter referred to as a suspension SA) of resin particles having a solid concentration of 8% by mass was obtained. The resin particles contained in the obtained suspension SA had a number average primary particle diameter of 31 nm and Tg of 71° C.

(Core External Additive Particles: Preparation of Resin Particles SB-1)

A 1-L three-necked flask equipped with a thermometer and a stirring impeller was set in a water bath at a temperature of 30° C. and charged with 790 mL of ion exchanged water and 30 mL of a cationic surfactant ("QUARTAMIN 24P" produced by Kao Corporation, 25% by mass aqueous solution of lauryltrimethylammonium chloride). Thereafter, a temperature inside the flask was increased to 80° C. using the water bath. Subsequently, two liquids (a third liquid and a fourth liquid) were each dripped into the flask contents at the temperature of 80° C. over 5 hours. The third liquid was a liquid mixture of 90 mL of methyl methacrylate, 40 mL of n-butyl acrylate, and 20 mL of (3-acrylamidepropyl)trimethylammonium chloride. The fourth liquid was a solution obtained by dissolving 0.5 g of potassium peroxodisulfate in 30 mL of ion exchanged water. Subsequently, the temperature inside the flask was maintained at 80° C. for 2 hours to polymerize the flask contents. As a result, a suspension of resin particles (a liquid containing a large number of resin particles) was obtained. Subsequently, the resin particles in the liquid were sedimented using a centrifugal separator. Thereafter, a supernatant was removed and the left resin particles were dried. As a result, a powder of the resin particles (resin particles SB-1) was obtained.

(Core External Additive Particles: Preparation of Resin Particles SB-2)

Resin particles SB-2 were prepared according to the same procedure as the preparation of the resin particles SB-1 in all aspects other than that a liquid mixture of 100 mL of methyl methacrylate, 30 mL of n-butyl acrylate, and 20 mL of (3-acrylamidepropyl)trimethylammonium chloride was used as the third liquid instead of the liquid mixture of 90 mL of methyl methacrylate, 40 mL of n-butyl acrylate, and 20 mL of (3-acrylamidepropyl)trimethylammonium chloride.

(Core External Additive Particles: Preparation of Resin Particles SB-3)

Resin particles SB-3 were prepared according to the same procedure as the preparation of the resin particles SB-1 in all aspects other than that the amount of ion exchanged water was changed from 790 mL to 785 mL and a liquid mixture of 75 mL of methyl methacrylate, 60 mL of n-butyl acrylate, and 20 mL of (3-acrylamidepropyl)trimethylammonium chloride was used as the third liquid instead of the liquid mixture of 90 mL of methyl methacrylate, 40 mL of n-butyl acrylate, and 20 mL of (3-acrylamidepropyl)trimethylammonium chloride.

(Core External Additive Particles: Preparation of Resin Particles SB-4)

Resin particles SB-4 were prepared according to the same procedure as the preparation of the resin particles SB-1 in all aspects other than that the amount of the cationic surfactant (QUARTAMIN 24P) was changed from 30 mL to 75 mL and a liquid mixture of 100 mL of methyl methacrylate, 30 mL of n-butyl acrylate, and 20 mL of (3-acrylamidepropyl) trimethylammonium chloride was used as the third liquid instead of the liquid mixture of 90 mL of methyl methacrylate, 40 mL of n-butyl acrylate, and 20 mL of (3-acrylamidepropyl)trimethylammonium chloride.

(Core External Additive Particles: Preparation of Resin Particles SB-5)

Resin particles SB-5 were prepared according to the same procedure as the preparation of the resin particles SB-1 in all aspects other than that the amount of ion exchanged water was changed from 790.0 mL to 871.2 mL, the amount of the cationic surfactant (QUARTAMIN 24P) was changed from 30 mL to 20 mL, and a liquid mixture of 72.8 mL of styrene and 6.0 mL of n-butyl acrylate was used as the third liquid instead of the liquid mixture of 90 mL of methyl methacrylate, 40 mL of n-butyl acrylate, and 20 mL of (3-acrylamidepropyl)trimethylammonium chloride.

Table 2 shows measurement results of a number average primary particle diameter (average equivalent circular diameter), a glass transition point (Tg), and a zeta potential at pH 4 for each of the resin particles SB-1 to SB-5 (powders) obtained as described above. For example, the resin particles SB-1 had a number average primary particle diameter of 62 nm, a glass transition point (Tg) of 86° C., and a zeta potential at pH 4 of +20 mV. The number average primary particle diameter (average equivalent circular diameter) was determined from a projection image of particles taken using a transmission electron microscope (TEM). The resin particles SB-1 to SB-5 (powders) each had sharp particle size distribution. Specifically, the resin particles SB-1 to SB-5 each substantially included only resin particles having a particle diameter (specifically, equivalent circular diameter) of at least "Dc−1 nm" and no greater than "Dc+1 nm" where "Dc" represents a particle diameter shown in Table 2. The glass transition point (Tg) was measured by differential scanning calorimetry described above. The zeta potential was measured according to a method described below.

<Method for Measuring Zeta Potential>

First, 1 g of a sample (resin particles) and 0.1 g of a 10% by mass aqueous solution of a nonionic surfactant ("EMULGEN (registered Japanese trademark) 120" produced by Kao Corporation, component: polyoxyethylene lauryl ether) were added to 99.9 g of ion exchanged water. Ultrasonic treatment was performed on the resultant liquid for 3 minutes using an ultrasonic liquid mixer ("Super Sonic VS-F100" sold by AS ONE Corporation, high-frequency output: maximum 100 W, oscillatory frequency: 50 kHz) to disperse the resin particles in the liquid. Subsequently, pH of the resultant dispersion of the resin particles was adjusted to 4 using a hydrochloric acid of 1N to obtain a dispersion of pH 4 containing the resin particles. Subsequently, a zeta potential of the resin particles was measured by electrophoresis (more specifically, laser Doppler electrophoresis) using the resultant dispersion of pH 4 as a measurement target. Specifically, a zeta potential of the resin particles in the dispersion at a temperature of 23° C. and pH 4 was measured using a zeta electrometer ("ELSZ-1000" produced by Otsuka Electronics Co., Ltd.) using the laser Doppler technique. Measurement was performed three times for each sample, and an arithmetic mean of the thus obtained three measured values was determined to be an evaluation value (zeta potential) of the sample.

[Production Method of Toners]

(Preparation of Toner Cores)

A polyester resin was synthesized by causing a reaction between a bisphenol A ethylene oxide adduct (specifically, an alcohol produced through addition of ethylene oxide to a bisphenol A framework) and an acid having multiple functional groups (more specifically, a terephthalic acid). As a result, a polyester resin having a hydroxyl value of 20 mg KOH/g, an acid value of 40 mg KOH/g, a softening point (Tm) of 90° C., a glass transition point (Tg) of 49° C., and an SP value of 11.2 $(cal/cm^3)^{1/2}$ was obtained.

Next, 100 parts by mass of the polyester resin obtained as described above, 5 parts by mass of a colorant (C.I. Pigment Blue 15:3, component: copper phthalocyanine pigment), and 5 parts by mass of a releasing agent (synthetic ester wax: "Nissan Electol (registered Japanese trademark) WEP-3" produced by NOF Corporation) were mixed using an FM mixer (product of Nippon Coke & Engineering Co., Ltd.).

Subsequently, the resultant mixture was melt-kneaded using a twin screw extruder ("PCM-30" produced by Ikegai Corp.). The resultant kneaded product was cooled and then pulverized using a pulverizer ("Turbo Mill" produced by Freund-Turbo Corporation). The resultant pulverized product was classified using a classifier ("Elbow Jet EJ-LABO" produced by Nittetsu Mining Co., Ltd.). As a result, toner cores having a volume median diameter ($D_{50}$) of 6 μm, roundness of 0.93, a glass transition point (Tg) of 51° C., and a softening point (Tm) of 91° C. were obtained.

(Core External Addition)

First, 1,000 g of the toner cores obtained as described above and resin particles (any of the resin particles SB-1 to SB-5 specified for each toner) of a type and in an amount shown in Table 1 were mixed for 10 minutes using an FM mixer (product of Nippon Coke & Engineering Co., Ltd.) at a rotational speed of 4,000 rpm. For example, in production of the toner TA-1, 1,000 g of the toner cores and 10 g of the resin particles SB-1 were mixed. In production of the toner TA-4, 1,000 g of the toner cores and 20 g of the resin particles SB-1 were mixed. In production of the toner TA-8, 1,000 g of the toner cores and 10 g of the resin particles SB-2 were mixed.

The above external addition (mixing of the toner cores and the resin particles) corresponds to "core external addition". All the resin particles (any of the resin particles SB-1 to SB-5) added by the core external addition adhered to surfaces of the toner cores. As a result, composite cores (specifically, the toner cores with the resin particles adhering to the surfaces thereof) were obtained.

(Shell Layer Formation Process)

A 1-L three-necked flask equipped with a thermometer and a stirring impeller was set in a water bath. The flask was charged with 300 mL of ion exchanged water, and a temperature inside the flask was maintained at 30° C. using the water bath. Subsequently, a 1 mol/L aqueous solution of p-toluenesulfonic acid was added into the flask to adjust pH of the flask contents to 4.

Subsequently, a shell material (suspension SA prepared as described above) in an amount shown in Table 1 was added into the flask. For example, in production of the toner TA-1, 37.0 g of the shell material (suspension SA) was added. In production of the toner TA-7, 74.0 g of the shell material (suspension SA) was added.

Subsequently, 300 g of the composite cores prepared as described above were added into the flask, and the flask contents were sufficiently stirred. Subsequently, 300 mL of ion exchanged water was added into the flask, and a temperature inside the flask was increased to 50° C. at a rate of 1° C./minute while the flask contents were stirred at a rotational speed (stirring impeller) of 100 rpm. Once the temperature inside the flask reached 50° C., a liquid mixture (liquid preheated to 50° C.) of 20 g of a 0.5 moles/liter aqueous solution of disodium hydrogenphosphate and 10 g of a 10% by mass aqueous solution of an anionic surfactant ("Emal (registered Japanese trademark) 0" produced by Kao Corporation, component: sodium lauryl sulfate) was added into the flask. Further, a temperature of the flask contents was increased at a rate of 1.0° C./minute while the flask contents were stirred at a rotational speed (stirring impeller) of 100 rpm. Once roundness of toner mother particles reached 0.965, the heating was stopped and cool water was added into the flask to rapidly cool the flask contents to room temperature (approximately 25° C.). Through the above, a shell layer was formed on a surface of each composite core in the liquid, and a dispersion of the toner mother particles was obtained. In each of the toner mother particles, the shell layer (specifically, a film of a styrene-acrylic acid-based resin) selectively covered surface regions of the composite core where resin particles were not present.

(Washing)

The dispersion of the toner mother particles obtained as described above was filtered (solid-liquid separated) using a Buchner funnel. As a result, a wet cake of the toner mother particles was obtained. The obtained wet cake of the toner mother particles was redispersed in ion exchanged water. Dispersion and Filtration were repeated five times to wash the toner mother particles.

(Drying Process)

Subsequently, the washed toner mother particles (powder) were dispersed in a 50% by mass aqueous ethanol solution. Through the above, a slurry of the toner mother particles was obtained. Subsequently, the toner mother particles in the slurry were dried using a continuous type surface modifier ("Coatmizer (registered Japanese trademark)" produced by Freund Corporation) under conditions of a hot air temperature of 45° C. and a blower flow rate of 2 $m^3$/minute. As a result, dry toner mother particles (powder) were obtained.

(Shell External Addition)

Subsequently, 200 g of the toner mother particles obtained as described above and 3 g of positively chargeable silica particles ("AEROSIL (registered Japanese trademark) REA90" produced by Nippon Aerosil Co., Ltd., content: dry silica particles to which positive chargeability was imparted through surface treatment, number average primary particle diameter: 20 nm) were mixed for 5 minutes using a UM mixer (product of Nippon Coke & Engineering Co., Ltd.). Through the above, the external additive adhered to surfaces of the toner mother particles. Thereafter, shifting was performed using a 200-mesh sieve (opening: 75 μm). Thus, each of the toners (toners TA-1 to TA-8 and TB-1 to TB-5) including a large number of toner particles was obtained.

Tables 1 and 2 show measurement results of a particle diameter of the core external additive particles (specifically, the resin particles constituted the composite core), a thickness (shell thickness) of the shell layer, and a glass transition point (Tg) of a resin forming the shell layer for each of the toners TA-1 to TA-8 and TB-1 to TB-5 obtained as described above. Also, Table 3 shows a value $R_S$ (=$S_1/S_2$) obtained by dividing the particle diameter ($S_1$) of the core external additive particles by the thickness ($S_2$) of the shell layer. Further, Table 3 shows a value ΔTg (=$Tg_1-Tg_2$) obtained by subtracting the glass transition point ($Tg_2$) of the resin forming the shell layer from a glass transition point ($Tg_1$) of a resin forming the core external additive particles.

TABLE 3

| Toner | $R_S$ (=$S_1/S_2$) | ΔTg(=$Tg_1$-$Tg_2$) [° C.] |
|---|---|---|
| TA-1 | 3.1 (=62/20) | +15 (=86-71) |
| TA-2 | 3.1 (=62/20) | +15 (=86-71) |
| TA-3 | 3.1 (=62/20) | +15 (=86-71) |
| TA-4 | 3.1 (=62/20) | +15 (=86-71) |
| TA-5 | 6.2 (=62/10) | +15 (=86-71) |
| TA-6 | 2.1 (=62/30) | +15 (=86-71) |
| TA-7 | 1.6 (=62/40) | +15 (=86-71) |
| TA-8 | 2.8 (=55/20) | +32 (=103-71) |
| TB-1 | 3.1 (=62/20) | +15 (=86-71) |
| TB-2 | 1.2 (=62/50) | +15 (=86-71) |
| TB-3 | 2.8 (=55/20) | −12 (=59-71) |
| TB-4 | 0.8 (=32/40) | +31 (=102-71) |
| TB-5 | 3.3 (=65/20) | +13 (=84-71) |

For example, in the toner TA-1, the core external additive particles had a number average primary particle diameter ($S_1$) of 62 nm, the shell layer had a thickness ($S_2$) of 20 nm, the resin forming the core external additive particles had a glass transition point ($Tg_1$) of 86° C., and the resin forming the shell layer had a glass transition point ($Tg_2$) of 71° C. In the toner TA-1, the number average primary particle diameter ($S_1$) of the core external additive particles was 3.1 times greater than the thickness ($S_2$) of the shell layer. In the toner TA-1, the glass transition point ($Tg_1$) of the resin forming the core external additive particles was 15° C. higher than the glass transition point ($Tg_2$) of the resin forming the shell layer.

The number average primary particle diameter of the core external additive particles was determined from a projection image of the particles taken using a transmission electron microscope (TEM). The thus determined particle diameter of the core external additive particles was the same as the particle diameter (see Table 2) at the time of addition thereof. The glass transition point (Tg) was measured by the differential scanning calorimetry described above. The thickness of the shell layer was measured according to a method described below.

<Method for Measuring Thickness of Shell Layer>

A sample (toner) was dispersed in a cold-setting epoxy resin and hardened in an atmosphere at a temperature of 40° C. for two days to obtain a hardened material. The obtained hardened material was dyed using osmium tetroxide and then sliced using an ultramicrotome ("EM UC6" produced by Leica Microsystems) equipped with a diamond knife to obtain a thin piece of the sample. A sectional image of the thin piece of the sample was taken using a transmission electron microscope (TEM) ("JSM-6700F" produced by JEOL Ltd.).

The thickness of the shell layer was measured through analysis of the TEM image using an image analysis software ("WinROOF" produced by Mitani Corporation). Specifically, two orthogonal straight lines intersecting with each other at substantially a center of a cross section of a toner particle were drawn, and lengths of portions of the two straight lines overlapped with the shell layer were measured at four positions where the two straight lines intersected with the shell layer. An arithmetic mean of the thus obtained four measured values was determined to be the thickness of the shell layer of the toner particle used as the measurement target. The thickness of the shell layer was measured for 20 toner particles included in the sample (toner), and a number average value of the thus obtained 20 measured values was determined to be an evaluation value (thickness of the shell layer) of the sample (toner).

It may be difficult to measure the thickness of the shell layer in a situation in which the shell layer is thin and a boundary between the toner core and the shell layer in the TEM is unclear. In such a situation, the boundary between the toner core and the shell layer was clarified using a combination of TEM and electron energy loss spectroscopy (EELS) to measure the thickness of the shell layer. Specifically, characteristic elements contained in the shell layer were mapped in the TEM image using EELS.

[Evaluation Methods]

Each of the samples (toners TA-1 to TA-8 and TB-1 to TB-5) was evaluated according to methods described below.

(High-Temperature Preservability)

First, 3 g of a sample (toner) was placed in a 20-mL polyethylene container and the container was sealed. Tapping treatment was performed on the sealed container for 5 minutes. Subsequently, the container was left to stand for 3 hours in a thermostatic chamber set to 58° C. Thereafter, the toner was taken out of the thermostatic chamber and cooled to room temperature (approximately 25° C.) to obtain an evaluation toner.

The evaluation toner was placed on a sieve having a known mass and openings of 106 μm. A mass of the toner on the sieve (mass of the toner prior to sifting) was calculated by measuring a total mass of the sieve and the toner thereon. Subsequently, the sieve was set in a powder property evaluation machine ("Powder Tester (registered Japanese trademark)" produced by Hosokawa Micron Corporation) and the evaluation toner was sifted by shaking the sieve for 30 seconds at a rheostat level of 5 in accordance with a manual of the powder tester. After the sifting, a mass of toner remaining on the sieve (mass of toner after the sifting) was calculated by measuring a total mass of the sieve and the toner thereon. A residual percentage (unit: % by mass) was calculated from the mass of the toner prior to the sifting and the mass of the toner after the sifting in accordance with the following equation.

$$\text{Residual percentage}=100\times(\text{mass of toner after sifting})/(\text{mass of toner prior to sifting})$$

A residual percentage not greater than 20% by mass was evaluated as very good, a residual percentage greater than 20% by mass and not greater than 40% by mass was evaluated as good, and a residual percentage greater than 40% by mass was evaluated as poor.

(Low-Temperature Fixability)

A two-component developer was prepared by mixing 100 parts by mass of a developer carrier (carrier for "TASKalfa5550ci" produced by KYOCERA Document Solutions Inc.) and 10 parts by mass of a sample (toner) for 30 minutes using a ball mill. In evaluation of the toner TB-5, a carrier for a negatively chargeable toner (carrier for "Anesis6016" produced by KYOCERA Document Solutions Inc.) was used as the developer carrier.

A printer ("FS-C5200DN" produced by KYOCERA Document Solutions Inc.) equipped with a roller-roller type heat and pressure fixing device (nip width: 8 mm) was modified so as to be capable of changing a fixing temperature for use as an evaluation apparatus. The two-component developer prepared as described above was loaded into a developing device of the evaluation apparatus and a sample (toner for replenishment use) was loaded into a toner container of the evaluation apparatus.

A solid image (specifically, unfixed toner image) having a size of 25 mm×25 mm was formed on evaluation paper ("ColorCopy (registered Japanese trademark)" produced by Mondi, A4 size, basis weight: 90 g/m$^2$) using the evaluation apparatus under conditions of a linear velocity of 200 mm/second and a toner application amount of 1.0 mg/cm$^2$ in an environment at a temperature of 20° C. and a relative humidity of 65%. Subsequently, the paper on which the image was formed was passed through the fixing device of the evaluation apparatus. Nip passage time was 40 milliseconds.

In evaluation of a lowest fixing temperature, the fixing temperature was set within a range from 120° C. to 160° C. Specifically, a lowest temperature (lowest fixing temperature) at which the solid image (toner image) was fixable to the paper was measured by increasing the fixing temperature of the fixing device from 120° C. in increments of 2° C. Whether or not the toner was fixable was determined by a fold-rubbing test described below. Specifically, the fold-rubbing test was performed by folding evaluation paper that had been passed through the fixing device in half such that a surface on which the image was formed was folded inwards, and rubbing a 1-kg brass weight covered with cloth back and forth on the image on the fold five times. Subsequently, the paper was unfolded and the folded portion (portion at which the solid image was formed) was observed. A length of toner peeling of the folded portion (peeling length) was measured. The lowest temperature among temperatures for which the peeling length was not greater than 1 mm was determined to be the lowest fixing temperature.

A lowest fixing temperature not higher than 134° C. was evaluated as very good, a lowest fixing temperature higher than 134° C. and not higher than 144° C. was evaluated as good, and a lowest fixing temperature higher than 144° C. was evaluated as poor. Evaluation reference values (134° C. and 144° C.) were determined based on a lowest fixing temperature (124° C.) of toner particles (non-capsule toner particles) including no shell layer.

(Charge Amount)

An evaluation developer was prepared by mixing 100 parts by mass of a ferrite carrier (carrier for "FS-C5100DN" produced by KYOCERA Document Solutions Inc.) and 6 parts by mass of a sample (toner) for 30 minutes using a ball mill in an environment at a temperature of 20° C. and a relative humidity of 65%. Thereafter, a charge amount of the toner in the evaluation developer was measured using a Q/m meter ("MODEL 210HS" produced by TREK, INC.) according to a method described below. In evaluation of the toner TB-5, a carrier for a negatively chargeable toner (carrier for "Anesis6016" produced by KYOCERA Document Solutions Inc.) was used as the carrier for preparing the evaluation developer.

<Method for Measuring Charge Amount of Toner in Developer>

First, 0.10 g of the developer (carrier and toner) was placed in a measurement cell of the Q/m meter, and only the toner in the developer was sucked through a sieve (wire netting) for 10 seconds. A charge amount (unit: μC/g) of the toner in the developer was calculated according to an expression "total electric amount (unit: μC) of sucked toner/mass (unit: g) of sucked toner".

A charge amount of 10 μC/g or greater was evaluated as very good, a charge amount of 3 μC/g or greater and less than 10 μC/g was evaluated as good, and a charge amount of less than 3 μC/g was evaluated as poor.

(Charge Decay Characteristic)

A charge decay constant α of a sample (toner) was measured in accordance with Japanese Industrial Standard (JIS) C 61340-2-1-2006 using an electrostatic diffusivity measuring device ("NS-D100" produced by Nano Seeds Corporation). The following describes a method for measuring the charge decay constant of the sample (toner) in detail.

The sample (toner) was placed in a measurement cell. The measurement cell was a metal cell with a recess having an inner diameter of 10 mm and a depth of 1 mm. The toner was thrust from above using a glass slide to fill the recess of the cell with the toner. A portion of the toner brimming over the cell was removed by reciprocating the glass slide on the surface of the cell. The cell was filled with at least 0.04 g and no greater than 0.06 g of the toner.

Subsequently, the measurement cell filled with the sample (toner) was left to stand for 12 hours in an environment at a temperature of 32.5° C. and a relative humidity of 80%. Subsequently, the measurement cell was grounded and placed in the electrostatic diffusivity measuring device. Ions were then supplied to the toner through corona discharge to charge the toner. Charging time was 0.5 seconds. After elapse of 0.7 seconds from completion of the corona discharge, a surface potential of the toner was measured continuously. The charge decay constant (charge decay rate) α was calculated based on the measured surface potential and an equation "$V=V_0\exp(-\alpha\sqrt{t})$". In the equation, V represents a surface potential [V], $V_0$ represents an initial surface potential [V], and t represents a decay period [second].

A charge decay constant not greater than 0.015 was evaluated as very good, a charge decay constant greater than 0.015 and not greater than 0.025 was evaluated as good, and a charge decay constant greater than 0.025 was evaluated as poor.

[Evaluation Results]

Table 4 shows evaluation results of the toners TA-1 to TA-8 and TB-1 to TB-5. Table 4 shows measured values for low-temperature fixability (lowest fixing temperature), high-temperature preservability (residual percentage), charge amount, and charge decay characteristic (charge decay constant).

TABLE 4

| | Toner | High-temperature preservability [% by mass] | Low-temperature fixability [° C.] | Charge amount [μC/g] | Charge decay characteristic |
|---|---|---|---|---|---|
| Example 1 | TA-1 | 19 (very good) | 134 (very good) | +19 (very good) | 0.015 (very good) |
| Example 2 | TA-2 | 36 | 132 (very good) | +9 | 0.014 (very good) |
| Example 3 | TA-3 | 16 (very good) | 138 | +30 (very good) | 0.016 |
| Example 4 | TA-4 | 13 (very good) | 142 | +36 (very good) | 0.016 |
| Example 5 | TA-5 | 35 | 132 (very good) | +23 (very good) | 0.015 (very good) |
| Example 6 | TA-6 | 10 (very good) | 138 | +15 (very good) | 0.017 |
| Example 7 | TA-7 | 4 (very good) | 144 | +11 (very good) | 0.018 |
| Example 8 | TA-8 | 18 (very good) | 134 (very good) | +24 (very good) | 0.013 (very good) |
| Comparative example 1 | TB-1 | 9 (very good) | 146 (poor) | +42 (very good) | 0.017 |
| Comparative example 2 | TB-2 | 3 (very good) | 150 (poor) | +6 | 0.018 |
| Comparative example 3 | TB-3 | 26 | 132 (very good) | +14 (very good) | 0.028 (poor) |
| Comparative example 4 | TB-4 | 45 (poor) | 134 (very good) | +15 (very good) | 0.014 (very good) |
| Comparative example 5 | TB-5 | 19 (very good) | 134 (very good) | −12 (poor) | 0.019 |

The toners TA-1 to TA-8 (toners according to Examples 1 to 8) each had the above-described basic features. Specifically, the toners TA-1 to TA-8 each included a plurality of toner particles each including a composite core and a shell layer partially covering a surface of the composite core. The composite core was a composite of a toner core containing a polyester resin and a plurality of resin particles (core external additive particles) each containing a first resin (specifically, a copolymer of methyl methacrylate, n-butyl acrylate, and (3-acrylamidepropyl)trimethylammonium chloride) (see "Preparation of Resin Particles SB-1" and "Preparation of Resin Particles SB-2"). The plurality of resin particles (core external additive particles) adhered to a surface of each toner core. The shell layer was a film containing a second resin (specifically, a styrene-acrylic acid-based resin). The first resin had a glass transition point ($Tg_1$) that is 10° C. or more higher than a glass transition point ($Tg_2$) of the second resin (see Table 3). The plurality of resin particles (core external additive particles) each had a particle diameter that is 1.5 times or more greater than a thickness of the shell layer (see Table 3). An amount of the resin particles (core external additive particles) was at least 0.3 parts by mass and no greater than 2.0 parts by mass relative to 100 parts by mass of the toner cores (see Table 1). For example, in the toner TA-1 that was produced using 10 g of the resin particles SB-1 (core external additive particles) and 1,000 g of the toner cores, an amount of the core external additive particles was 1.0 part by mass relative to 100 parts by mass of the toner cores. The core external additive particles (specifically, the resin particles SB-1 or SB-2) had a positive zeta potential (>0 mV) at pH 4 measured by laser Doppler electrophoresis (see Table 2).

In each of the toners TA-1 to TA-8, the shell layer had a configuration substantially the same as that illustrated in FIG. 2.

As shown in Table 4, the toners TA-1 to TA-8 were excellent in high-temperature preservability, low-temperature fixability, positive chargeability, and charge retention (charge decay characteristic).

What is claimed is:

1. An electrostatic latent image developing toner comprising:

a plurality of toner particles each including a composite core and a shell layer partially covering a surface of the composite core, wherein the composite core is a composite of a toner core containing a polyester resin and a plurality of resin particles each containing a first resin, the plurality of resin particles each adhere to a surface of the toner core, the shell layer is a film containing a second resin, the first resin has a glass transition point that is 10° C. or more higher than a glass transition point of the second resin, the plurality of resin particles each have a particle diameter that is 1.5 times or more greater than a thickness of the shell layer, an amount of the resin particles is at least 0.3 parts by mass and no greater than 2.0 parts by mass relative to 100 parts by mass of the toner cores, the resin particles have a positive zeta potential at pH 4 measured by laser Doppler electrophoresis, the resin particles each include a top portion, a middle portion, and a bottom portion, the top portion of each resin particle protrudes from a surface of the shell layer, the middle portion of each resin particle is in contact with the shell layer, and the bottom portion of each resin particle is embedded in the toner core.

2. The electrostatic latent image developing toner according to claim 1, wherein the shell layer selectively covers a surface region of the composite core where the resin particles are not present.

3. The electrostatic latent image developing toner according to claim 1, wherein the toner particles each include: a toner mother particle including the composite core and the shell layer; and an external additive adhering to a surface of the toner mother particle, the external additive includes a powder of inorganic particles adhering to the surface of the toner mother particle mainly by Van der Waals force or electrostatic force, and the powder of the inorganic particles has a number average primary particle diameter of at least 10 nm and no greater than 30 nm.

4. The electrostatic latent image developing toner according to claim 1, wherein the thickness of the shell layer is at least 10 nm and no greater than 40 nm, and the particle diameter of each of the plurality of resin particles is at least 30 nm and no greater than 100 nm.

5. The electrostatic latent image developing toner according to claim 4, wherein the second resin is a thermoplastic resin, the shell layer is a film substantially formed from the thermoplastic resin, the first resin is more readily positively chargeable than the second resin, and the second resin is more hydrophobic than the first resin.

6. The electrostatic latent image developing toner according to claim 5, wherein the shell layer covers at least 70% and no greater than 95% of a surface area of the toner core.

7. The electrostatic latent image developing toner according to claim 1, wherein the first resin is a polymer of monomers including a (meth)acryloyl group-containing quaternary ammonium compound, and the second resin is a polymer of monomers including a styrene-based monomer and a (meth)acrylic acid alkyl ester.

8. The electrostatic latent image developing toner according to claim 1, wherein the first resin is a polymer of monomers including a (meth)acrylamidoalkyltrimethylammonium salt and an acrylic acid-based monomer, and the second resin is a polymer of monomers including a styrene-based monomer and a (meth)acrylic acid alkyl ester.

9. The electrostatic latent image developing toner according to claim 1, wherein the first resin includes a repeating unit represented by formula (1) shown below and a repeating unit represented by formula (2) shown below, a quaternary ammonium cation in the repeating unit represented by formula (1) forms a salt through ionic bonding to chlorine, and the second resin includes a repeating unit represented by formula (3) shown below, (1)

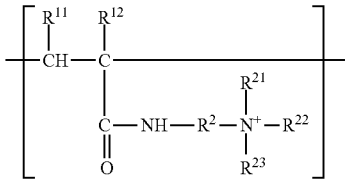

where in formula (1), $R^{11}$ and $R^{12}$ each represent, independently of one another, a hydrogen atom, a halogen atom, or an optionally substituted alkyl group, $R^{21}$, $R^{22}$, and $R^{23}$ each represent, independently of one another, a hydrogen atom, an optionally substituted alkyl group, or an optionally substituted alkoxy group, and $R^{2}$ represents an optionally substituted alkylene group, (2)

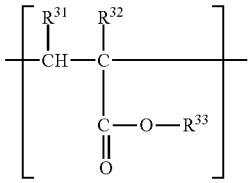

in formula (2), $R^{31}$ and $R^{32}$ each represent, independently of one another, a hydrogen atom, a halogen atom, or an optionally substituted alkyl group, and $R^{33}$ represents a hydrogen atom or an optionally substituted alkyl group, (3)

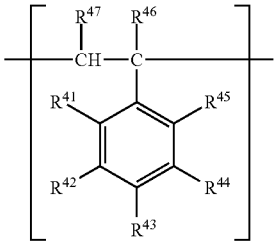

in formula (3), $R^{41}$ to $R^{45}$ each represent, independently of one another, a hydrogen atom, a halogen atom, a hydroxyl group, an optionally substituted alkyl group, an optionally substituted alkoxy group, or an optionally substituted aryl group, and $R^{46}$ and $R^{47}$ each represent, independently of one another, a hydrogen atom, a halogen atom, or an optionally substituted alkyl group.

* * * * *